US009624896B2

(12) United States Patent
Neet et al.

(10) Patent No.: US 9,624,896 B2
(45) Date of Patent: Apr. 18, 2017

(54) STARTER ASSEMBLY

(71) Applicant: REMY TECHNOLOGIES, L.L.C., Pendleton, IN (US)

(72) Inventors: Kirk Neet, Pendleton, IN (US); David Fulton, Anderson, IN (US); Andrew Dragon, Fishers, IN (US)

(73) Assignee: REMY TECHNOLOGIES, L.L.C., Pendleton, IN (US)

( * ) Notice: Subject to any disclaimer, the term of this patent is extended or adjusted under 35 U.S.C. 154(b) by 55 days.

(21) Appl. No.: 14/743,426

(22) Filed: Jun. 18, 2015

(65) Prior Publication Data

US 2015/0369201 A1 Dec. 24, 2015

Related U.S. Application Data

(60) Provisional application No. 62/013,940, filed on Jun. 18, 2014.

(51) Int. Cl.

| | |
|---|---|
| ***F02N 15/06*** | (2006.01) |
| *F02N 11/00* | (2006.01) |
| *F02N 15/02* | (2006.01) |

(52) U.S. Cl.

CPC ..... *F02N 15/063* (2013.01); *F02N 11/00* (2013.01); *F02N 15/022* (2013.01); *Y10T 74/13* (2015.01)

(58) Field of Classification Search

CPC ..... F02N 15/06; F02N 15/063; F02N 11/00; F02N 15/022; F02N 15/067

See application file for complete search history.

(56) References Cited

U.S. PATENT DOCUMENTS

| | | | | |
|---|---|---|---|---|
| 3,263,509 | A * | 8/1966 | Digby | F02N 15/026 192/104 R |
| 3,772,921 | A * | 11/1973 | Carlson | F02N 15/06 74/7 A |
| 4,261,452 | A * | 4/1981 | Barrows | F02N 15/02 192/103 R |
| 5,129,270 | A * | 7/1992 | Hasebe | F02N 15/06 74/7 C |
| 2002/0029644 | A1 * | 3/2002 | Yamauchi | F02N 15/06 74/7 A |

(Continued)

FOREIGN PATENT DOCUMENTS

JP 2009138656 A 6/2009

OTHER PUBLICATIONS

Office Action issued in related KR Patent Application No. 10-2015-0085394 on Sep. 20, 2016, 8 pages.

*Primary Examiner* — William Kelleher
*Assistant Examiner* — Jake Cook
(74) *Attorney, Agent, or Firm* — Cantor Colburn LLP

(57) ABSTRACT

A starter assembly is provided and includes a shaft to transmit rotation to a ring gear via a pinion and including a first helical spline with angling directed reversely with respect to a direction of the rotation and an elastic element anchored on the first helical spline to bias the pinion in an axial direction. The ring gear and the pinion include complementary teeth and the pinion defines a bore with a second helical spline to register with the first helical spline such that the pinion teeth are forwardly rotated into ring gear teeth engagement positions as the shaft moves axially relative to the pinion in the axial direction.

15 Claims, 4 Drawing Sheets

(56) References Cited

U.S. PATENT DOCUMENTS

| | | | | |
|---|---|---|---|---|
| 2003/0056610 | A1* | 3/2003 | Yamada | F02N 15/06 74/7 A |
| 2013/0081514 | A1* | 4/2013 | Abe | F02N 11/0855 74/7 C |

* cited by examiner

STARTER ASSEMBLY

CROSS REFERENCE TO RELATED APPLICATION

This application is a Non-Provisional of U.S. Application No. 62/013,940 filed Jun. 18, 2014, the disclosures of which are incorporated by reference herein in its entirety.

BACKGROUND OF THE INVENTION

The subject matter disclosed herein relates to a starter assembly and, more particularly, to a starter assembly including a pinion with a helix angle spline.

Starter assemblies typically include a solenoid element that rotates lever arm to move a motor-driven driveshaft into registration with a ring gear so that the rotational energy of the driveshaft can be transmitted to the ring gear via a pinion. It has been seen, however, that the pinion is not always disposed in a rotational position that permits pinion-ring gear engagement. This rotational misalignment can lead to delayed transmission of rotational energy to the ring gear as well as wear and/or damage.

BRIEF DESCRIPTION OF THE INVENTION

According to one aspect of the invention, a starter assembly is provided and includes a shaft to transmit rotation to a ring gear via a pinion and including a first helical spline with angling directed reversely with respect to a direction of the rotation and an elastic element anchored on the first helical spline to bias the pinion in an axial direction. The ring gear and the pinion include complementary teeth and the pinion defines a bore with a second helical spline to register with the first helical spline such that the pinion teeth are forwardly rotated into ring gear teeth engagement positions as the shaft moves axially relative to the pinion in the axial direction.

According to another aspect of the invention, a starter assembly is provided and includes a pinion, an output shaft to transmit rotation to a drive assembly ring gear via the pinion and including a first helical spline with angling directed reversely with respect to a direction of the rotation and an elastic element anchored on the first helical spline to bias the pinion in an axial direction. The ring gear and the pinion include complementary teeth and the pinion defines a bore with a second helical spline to register with the first helical spline such that the pinion teeth are forwardly rotated into respective engagement positions with the ring gear teeth as the output shaft and the first helical spline move axially relative to the pinion in the axial direction.

According to yet another aspect of the invention, a starter assembly including a driveshaft rotatable in a rotation direction is provided and includes a pinion, an output shaft to transmit driveshaft rotation to a drive assembly ring gear via the pinion and including a first helical spline with angling directed reversely with respect to a direction of the rotation and a bias assembly including a stopper and an elastic element anchored on the first helical spline to bias the pinion toward the stopper. The ring gear and the pinion include complementary teeth, and the pinion defines a bore with a second helical spline to register with the first helical spline such that the pinion teeth are forwardly rotated into respective engagement positions with the ring gear teeth as the output shaft and the first helical spline move axially relative to the pinion against the bias.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
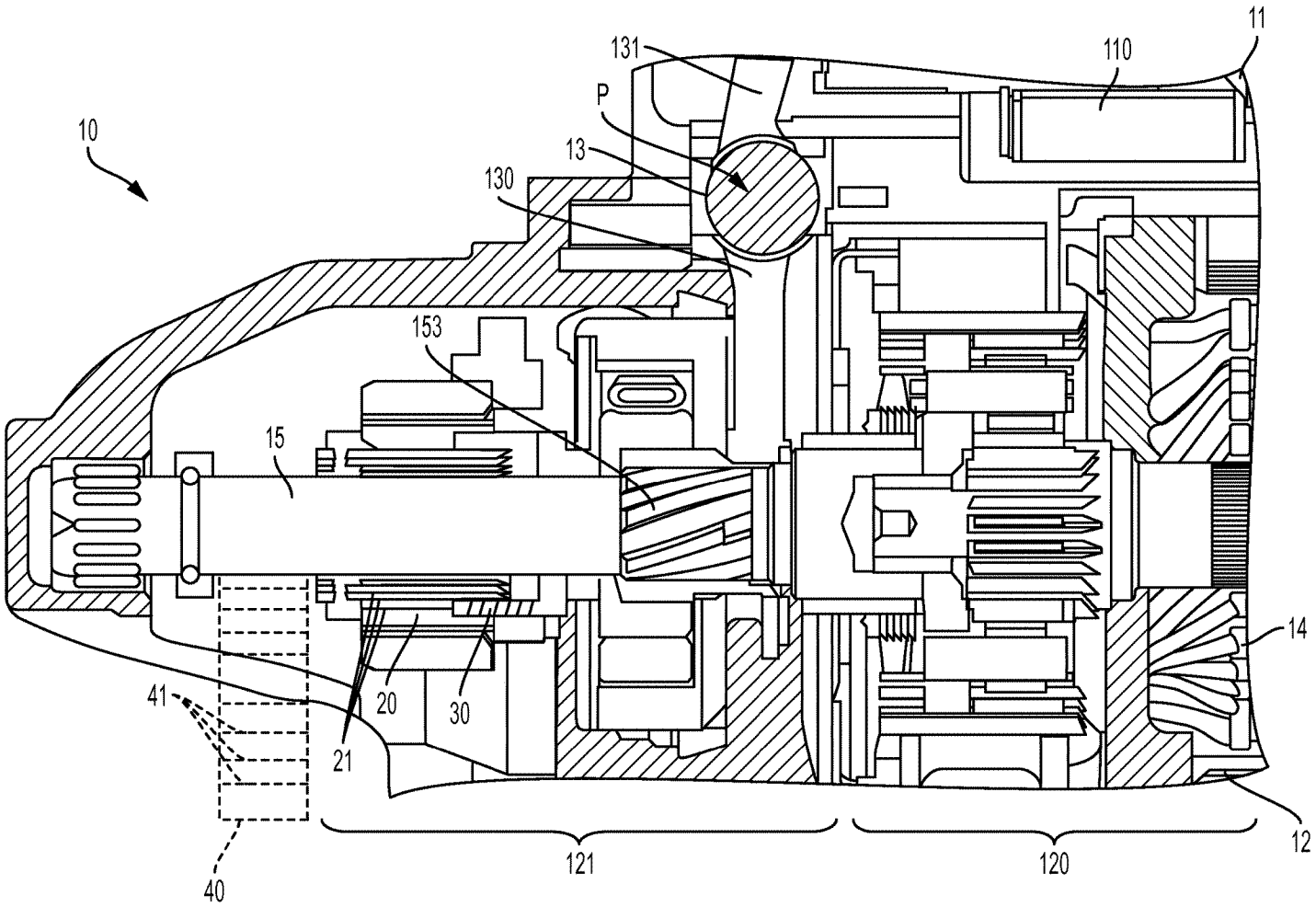
FIG. 1 is a side view of a starter assembly in accordance with embodiments.
Figure 3:
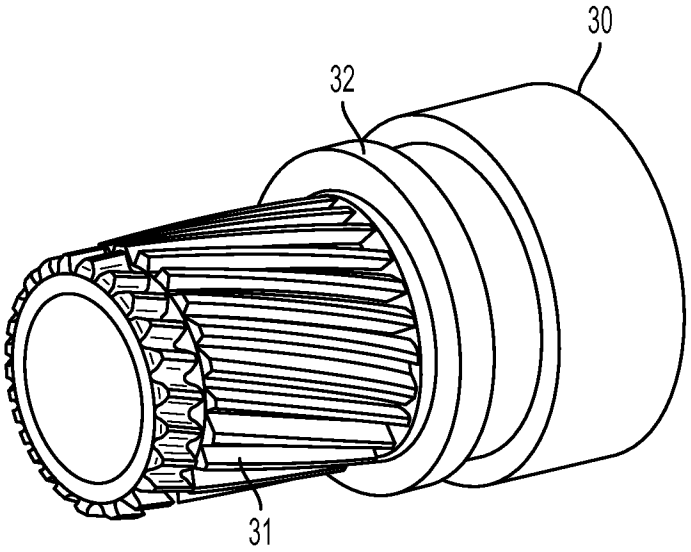
FIG. 3 is a perspective view of a helical spline of the starter assembly of FIG. 1.

The detailed description explains embodiments of the invention, together with advantages and features, by way of example with reference to the drawings.

DETAILED DESCRIPTION OF THE INVENTION

With reference to FIGS. 1-4B, a starter assembly 10 is provided and includes a control section 11, a drive section 12 and a lever arm 13, which has a first end 130 and a second end 131 opposite the first end 130 and which is rotatable or pivotable about a pivot axis P. The control section 11 includes a solenoid element 110 that is coupled to the second end 131 and configured to operably rotate the lever arm 13 about the pivot axis P to move the first end 130 accordingly. The drive section 12 has an input portion 120 and an output portion 121. The input portion 120 includes a motor 14 and a driveshaft 15 that is rotatable by the motor 14 in a forward rotation direction.

The driveshaft 15 includes a first driveshaft helix spline 153 with angling directed reversely with respect to a direction of the rotation of the driveshaft 15 when the motor 14 is energized. The output shaft 30 includes a second driveshaft helix spline 150 facing radially inward to register with the first driveshaft helix spline 153. The first end 130 of the lever arm 13 is operably connected to the output shaft 30. When the solenoid element 110 is energized to rotate the lever arm 13 around the pivot axis P, the first end 130 urges the output shaft 30 towards the ring gear 40 causing the output shaft 30 to also rotate in the reverse direction due to the registry of the second driveshaft helix spline 150 with the first driveshaft helix spline 153.

Figure 4A:
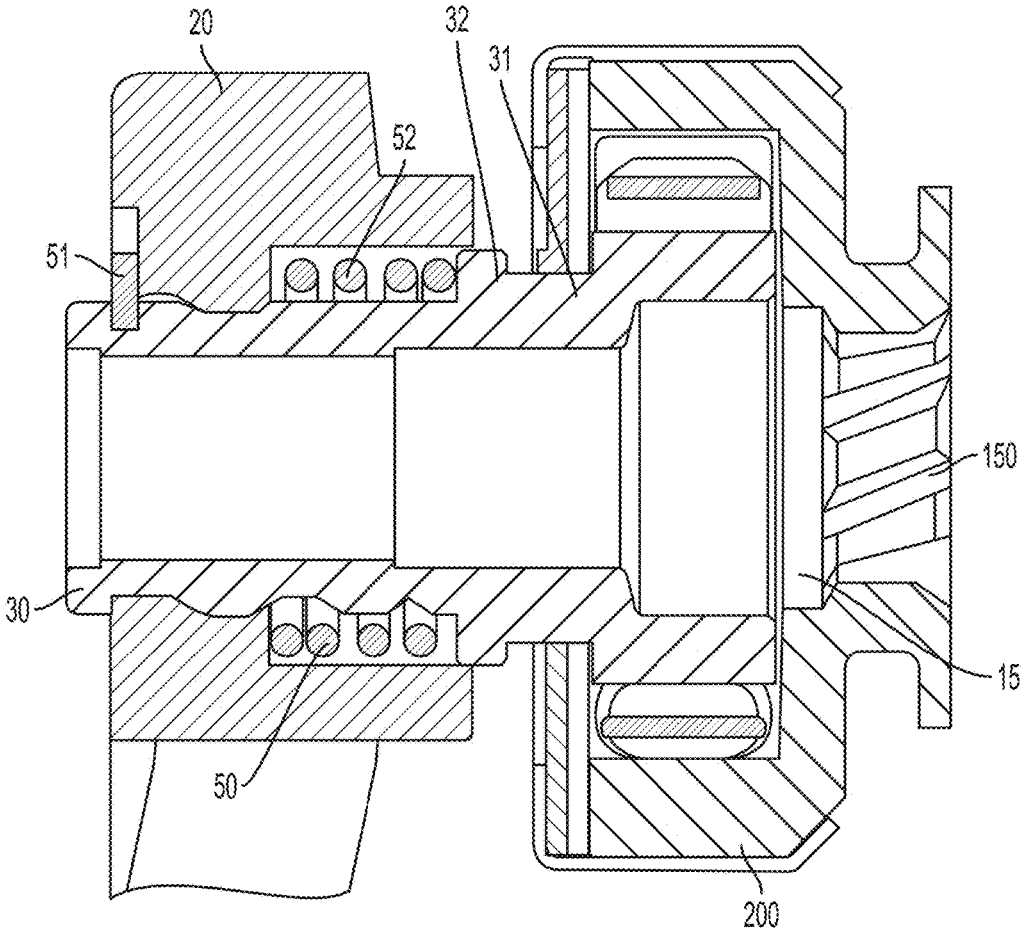
FIG. 4A is a side view of an engagement of the pinion and the helical spline of FIGS. 2 and 3, respectively and a forward angle driveshaft helical spline, in accordance with an aspect of an exemplary embodiment
Figure 4B:
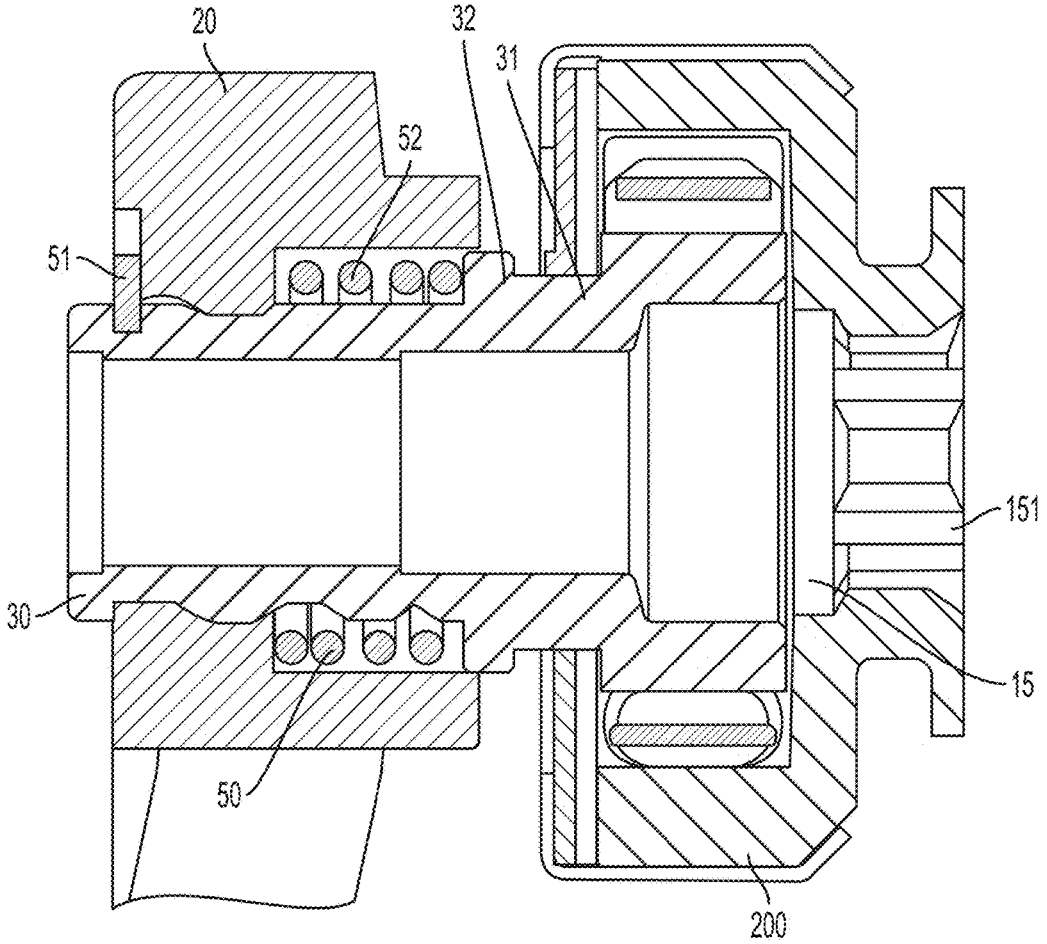
FIG. 4B is a side view of a driveshaft including a zero-angle driveshaft spline, in accordance with an aspect of an exemplary embodiment.

The output portion 121 includes a pinion 20 (see FIG. 2), an output shaft 30 (see FIG. 3) disposed to transmit rotation of the driveshaft 15 to a drive assembly ring gear 40 via the pinion 20 and a bias assembly 50 (see FIG. 4A). The output shaft 30 includes a first helical spline 31 with angling directed reversely with respect to a direction of the rotation of the driveshaft 15 when the motor 14 is energized. The output shaft 30 and the first helical spline 31 are axially movable toward the output portion 121 and the ring gear 40 by the first end 130 of the lever arm 13 responsive to an operation of the solenoid element 110. When this occurs, the rotation of the driveshaft 15 can be transferred to the ring gear 40 via the pinion 20 as long as the pinion 20 is rotatably disposed in an engagement position with respect to the ring gear 40.

As shown in FIG. 4A, the bias assembly 50 includes a clip or stopper 51, which is disposed in a circumferential groove defined in the first helical spline 31 and extends radially outwardly to thereby limit a distance the pinion 20 can be displaced relative to the output shaft 30, and an elastic element 52. The elastic element 52, which may be one of a compression spring or a torsional spring, is anchored on a flange 32 of the first helical spline 31 to bias the pinion 20 toward the stopper 51.

The ring gear 40 may be disposed in a region of the output portion 121 and includes radially outwardly extending ring gear teeth 41 and the pinion 20 includes radially outwardly extending pinion teeth 21. The pinion teeth 21 and the ring gear teeth 41 are complementary with respect to one another and can mesh with the pinion 20 being axially disposed to register with the ring gear 40.

Figure 2:
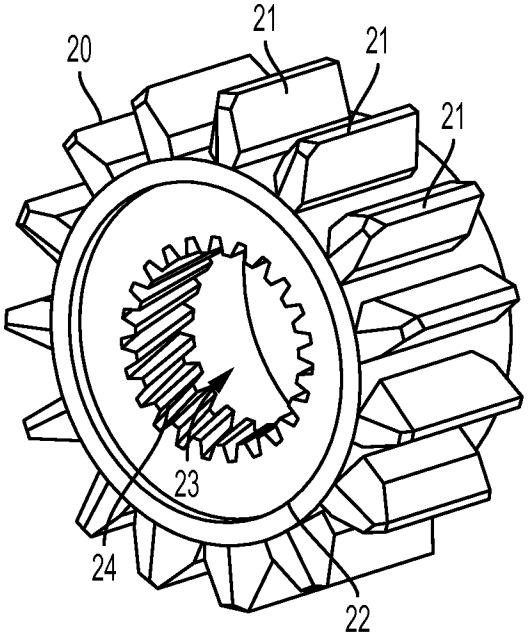
FIG. 2 is a perspective view of a pinion of the starter assembly of FIG. 1.

As shown in FIG. 2, the pinion 20 includes a body 22 that is formed to define a bore 23 with a second helical spline 24 facing radially inwardly to register with the first helical spline 31. The pinion 20 is disposable in a mounted condition on the first helical spline 31.

The axial movement of the output shaft 30 and the first helical spline 31 extends over a predefined distance. During an initial stage of the movement, the pinion 20 moves with the output shaft 30 and eventually abuts with the ring gear 40. At this point, due to the abutment, the pinion 20 can no longer move toward the ring gear and the elastic element 52 compresses to permit continued movement of the output shaft 30 and the first helical spline 31 toward the ring gear 40, which turn, causes the pinion 20 to spin in the forward direction due to the registry of the first and second helical splines 31 and 24.

The forward direction rotation of the pinion 20 is timed such that the pinion teeth 21 are forwardly rotated into respective engagement positions with the ring gear teeth 41 as the output shaft 30 and the first helical spline 31 continue to move axially relative to the pinion 20 against the bias applied by the elastic element 52 during an intermediate stage of the movement. Once the forward direction rotation of the pinion 20 rotates enough, the pinion teeth 21 are aligned with the grooves between adjacent ring gear teeth 41 so that continued axial movement of the output shaft 30 and the first helical spline 31 can force additional axial movement of the pinion 20 into a registration disposition with respect to the ring gear 40 as a final stage of the movement.

An angling and a length of each of the first and second helical splines 31 and 24 are predefined in view of various design factors. For example, a magnitude of the angling must be sufficient to encourage enough forward direction rotation of the pinion 20 to cause the pinion teeth 21 to align with the gap in between teeth 41 on the ring gear 40. On the other hand, the magnitude of the angling cannot be so great as to cause wear and tear of the pinion 20 or the output shaft 30.

In accordance with embodiments, the driveshaft 15 may include a driveshaft helical spline (not separately labeled) that engages with corresponding helical spline elements 150 and 153 provided on a clutch assembly 200 (FIG. 4A). Helical spline elements 150 and 153, have a rearward angling of 25° to 30°. In these cases, the first and second helical splines 31 and 24 have angling of 25° or less, non-inclusively, and in accordance with particular embodiments, the first and second helical splines 31 and 24 may have angling of about 15°. In accordance with alternative embodiments, the driveshaft helical spline 150 may have substantially reduced angling (i.e., 15° or less) or the driveshaft 15 may include a zero-angle driveshaft spline (not separately labeled) that engages with corresponding zero-angle spline elements 151 on clutch assembly 200 (see FIG. 4B) and, in these cases, the first and second helical splines 31 and 24 may have angling of about 15° or less, non-inclusively. In any case, a distance of the axial movement of the output shaft 30 and the first helical spline 31 relative to the pinion 20 is sufficient to cause rotation of the pinion teeth 21 by an angle defined by the arc-length of the grooves between adjacent ring gear teeth 41.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A starter assembly, comprising:

a pinion;

an output shaft to transmit rotation to a drive assembly ring gear via the pinion and including a first helical spline having a first angle directed reversely with respect to a direction of the rotation;

a clutch assembly operatively connected to the output shaft, the clutch assembly including helical spline elements having a second angle that is greater than the first angle; and an elastic element anchored on the first helical spline to bias the pinion in an axial direction, the ring gear and the pinion including complementary teeth, and the pinion defining a bore with a second helical spline having a third angle that registers with the first angle of the first helical spline such that the pinion teeth are forwardly rotated into respective engagement positions with the ring gear teeth as the output shaft and the first helical spline move axially relative to the pinion in the axial direction.

2. The starter assembly according to claim 1, wherein the first angle of the first helical splines and the third angle of the and second helical spline are about 25° or less.

3. The starter assembly according to claim 1, wherein the first angle of the first helical spline and the third angle of the second helical spline are about 15°.

4. The starter assembly according to claim 1, wherein a distance of axial movement of the output shaft and the first helical spline relative to the pinion is sufficient to cause teeth rotation by an angle between adjacent ring gear teeth.

5. The starter assembly according to claim 1, wherein the elastic element comprises one of a compression spring or a torsional spring.

6. The starter assembly according to claim 1, further comprising a driveshaft helix spline having a fourth angle directed reversely with respect to a direction of the rotation of a driveshaft when the motor is energized, the driveshaft helical spline registering with the helical spline elements on the clutch assembly.

7. The starter assembly according to claim 6 wherein the second angle of the helical spline elements and the fourth angle of the driveshaft helical spline are about 25° to 30°.

8. A starter assembly including a driveshaft rotatable in a rotation direction and comprising:

a pinion;

an output shaft to transmit driveshaft rotation to a drive assembly ring gear via the pinion and including a first helical spline having a first angle directed reversely with respect to a direction of the rotation;

a clutch assembly operatively connected to the output shaft, the clutch assembly including helical spline elements having a second angle that is greater than the first angle; and a bias assembly including a stopper and an elastic element anchored on the first helical spline to bias the pinion toward the stopper, the ring gear and the pinion including complementary teeth, and the pinion defining a bore with a second helical spline having a third angle that registers with the first angle of the first helical spline such that the pinion teeth are forwardly rotated into respective engagement positions with the ring gear teeth as the output shaft and the first helical spline move axially relative to the pinion against the bias.

9. The starter assembly according to claim 8, further comprising:

a lever arm including a first end disposed to move the output shaft and the first helical spline axially relative to the pinion and a second end opposite the first end; and a solenoid coupled to the second end and configured to operably rotate the lever arm about a pivot axis to move the first end accordingly.

10. The starter assembly according to claim 9, wherein the driveshaft includes a driveshaft helical spline having a fourth angle that registers with the helical spline elements of the clutch assembly, the second angle and the fourth angle being about 25°.

11. The starter assembly according to claim 10, wherein the first angle of the first helical splines and the third angle of the second helical splines are about 25° or less.

12. The starter assembly according to claim 11, wherein a distance of axial movement of the output shaft and the first helical spline relative to the pinion is sufficient to cause teeth rotation by an angle between adjacent ring gear teeth.

13. The starter assembly according to claim 10, wherein the first angle of the first helical splines and the third angle of the second helical splines are about 15°.

14. The starter assembly according to claim 13, wherein a distance of axial movement of the output shaft and the first helical spline relative to the pinion is sufficient to cause teeth rotation by an angle between adjacent ring gear teeth.

15. The starter assembly according to claim 8, wherein the elastic element comprises one of a compression spring or a torsional spring.

* * * * *